US005435394A

United States Patent [19]

Robertson

[11] Patent Number: 5,435,394

[45] Date of Patent: Jul. 25, 1995

[54] ANCHOR SYSTEM FOR PIPE CUTTING APPARATUS

[75] Inventor: Michael C. Robertson, Alvarado, Tex.

[73] Assignee: MCR Corporation, Alvarado, Tex.

[21] Appl. No.: 251,911

[22] Filed: Jun. 1, 1994

[51] Int. Cl.[6] ..... E21B 29/00

[52] U.S. Cl. ..... 166/382; 166/55; 166/297

[58] Field of Search ..... 166/55–55.8, 166/382, 297, 298, 206–212

[56] References Cited

U.S. PATENT DOCUMENTS 4,184,430 1/1980 Mock ..... 166/297 X
4,298,063 11/1981 Regalbuto et al. ..... 166/55
4,352,397 10/1982 Christopher ..... 166/55 X
4,598,769 7/1986 Robertson ..... 166/55

*Primary Examiner*—Michael Powell Buiz

*Attorney, Agent, or Firm*—Pravel, Hewitt, Kimball & Krieger

[57] ABSTRACT

An apparatus for cutting pipe disposed in a string down a borehole of an oil or gas well, including an elongated body for lowering into the bore of the string and defining an annulus between the body and the pipe wall, a quantity of combustible material supported within the elongated body, for providing a cutting flame when the material is ignited, a nozzle to direct the cutting flame radially outward from the body against the wall of the pipe to be cut, and an anchor supported along the lower end of the body, of a desired length and diameter defining an annulus below the cutting nozzle, so that upon the ignition of the material, the pressure of the gases produced by the ignition which collect in the annulus formed by the anchor below the nozzle is substantially equal to the gas pressure in the annulus formed by the body, and the cutting nozzle is maintained at a stable point within the hole to produce an even cut. The cutting device used in the method of the present invention may also include a chemical cutting device.

10 Claims, 3 Drawing Sheets

ANCHOR SYSTEM FOR PIPE CUTTING APPARATUS

BACKGROUND OF THE INVENTION

1. Field of the Invention

The present invention relates to pipe cutting operations. More particularly, the present invention relates to an anchoring system for a pipe cutting apparatus by equalizing the forces above and below the cutting portion of the apparatus to prevent movement of the cutting apparatus during cutting operations, and eliminating mechanical anchoring systems and pressure activated button/slip anchor systems.

2. General Background

During drilling or production of oil and gas wells, quite often a string of casing or drill pipe or other tubular members which is downhole cannot be retrieved from the well, due to the string becoming lodged downhole at some point along its length. Therefore, there are devices known in the art which are lowered into the bore of the pipe or casing, and through either chemicals or heat imparted to the pipe or casing wall, the pipe or casing is cut, and the casing or pipe above the cut is removed from the borehole, and the pipe or casing below the cut must remain in the well.

One such device is disclosed and claimed in U.S. Pat. No. 4,598,769, entitled "Pipe Cutting Apparatus," by the same inventor, Michael C. Robertson, which is incorporated herein by reference thereto. One of the features of the device disclosed in the '769 Robertson patent, is the feature of an anchoring system on the device. As in all devices of this type, when the device has been lowered to the desired depth, the device is mechanically anchored within the bore of the pipe or casing with a plurality of jaws which move outward from the tool body and engage the wall of the casing or pipe. The engagement of the jaws against the pipe or casing wall prevents the apparatus from moving within the casing or pipe when the cutting apparatus is fired. Since the device disclosed in the '769 Robertson patent utilizes a chemical reaction to produce the tremendous heat against the pipe in order to burn through the pipe wall, there is produced a volume of gas into the borehole at the point of the cut. This volume of gas, under very high pressure, tends to build up a tremendous upward pressure residing beneath the cutting apparatus. Therefore, were it not for the mechanical anchor system as described above, the force of the gas beneath the apparatus would tend to force the apparatus upward, in the borehole, which is very undesirable. Since this would occur simultaneously with the cutting operation, it would produce a very uneven and jagged cut, and may also be of such magnitude to propel the apparatus out of the borehole, causing damage, and perhaps endangering the safety of the workers on the rig floor.

The shortcomings of the mechanical anchors as is used currently in the art is the fact that the anchors must be set manually and properly prior to firing the mechanism, and therefore, results in preliminary preparation within the borehole prior to the actual cutting operation. Further, because of the mechanical nature of the anchor system, the anchors may not set properly, resulting in movement of the cutting apparatus, or may not function at all, and would require the entire tool to be retrieved from the hole for service.

SUMMARY OF THE PRESENT INVENTION

The improved anchoring system of the present invention solves the shortcomings in the art in a simple and straightforward manner. What is provided is an apparatus for cutting pipe disposed in a string down a borehole of an oil or gas well, which includes an elongated body for lowering into the bore of the string and defining an annulus between the tool body and the pipe wall above a cutting nozzle; a quantity of combustible material supported within the elongated body for providing a cutting flame when the material is ignited; a means to direct the cutting flame radially outward from the cutting nozzle against the wall of the pipe to be cut; and an anchor supported along the lower end of the body, of a desired length and width defining an annulus below the cutting nozzle, so that upon the ignition of the material, the pressure of the gases produced by the ignition which collect in the annulus formed by the anchor below the nozzle is substantially equal to the gas pressure in the annulus formed by the body above the cutting nozzle, resulting in an equalizing of the forces above and below the cutting nozzle, and maintaining the cutting nozzle at a stable point within the hole during the cutting operation.

Therefore, it is a principal object of the present invention to provide an anchor system for a downhole cutting apparatus which does not require manual anchoring against the wall of the pipe to be cut in order to anchor the cutting tool;

It is a further principal object of the present invention to provide an anchor system for a downhole cutting system which utilizes a secondary body secured to the lower end of the principal body, to establish an annulus below the cutting portion of the tool, which equalizes the pressure of the gases above and below the cutting portion produced during cutting;

It is a further object of the present invention to provide an anchoring system based upon equaling the forces above and below a cutting means so that the tool is maintained stable within the borehole during the cutting operation, and eliminate the use of a mechanical anchoring system for a downhole cutting tool;

It is a further object of the present invention to provide an anchor system for a downhole cutting apparatus which may utilize both combustible means or chemical means to cut the wall of the pipe to be cut, and does not require manual anchoring against the wall of the pipe to be cut in order to anchor the cutting tool;

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
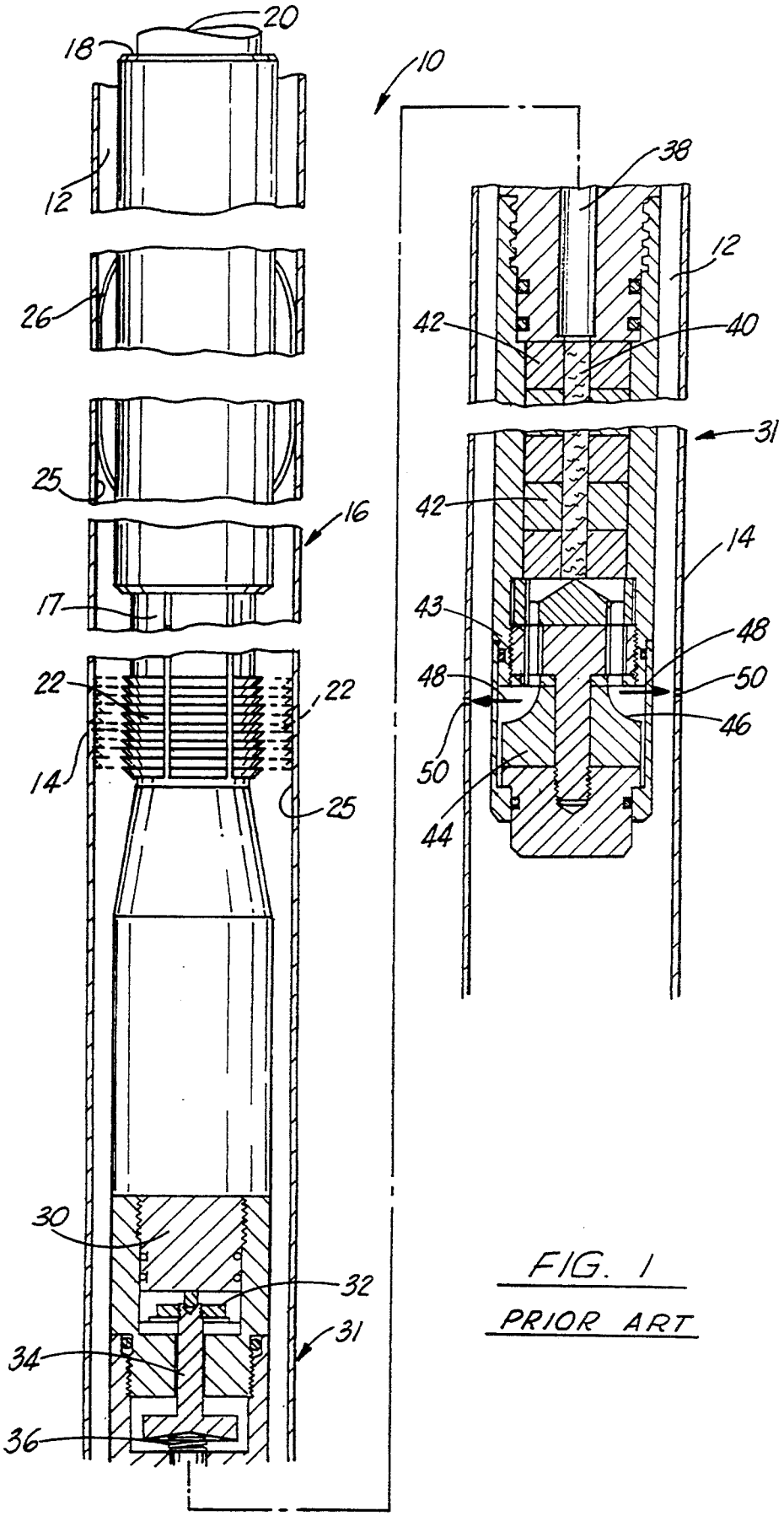
FIG. 1 PRIOR ART
FIG. 1 illustrates the prior art cutting apparatus as mechanically anchored downhole.

Before discussing the novel anchoring system of the present invention, reference is made to FIG. 1 which illustrate in detail the current state of the art in down hole cutting apparatuses, and is labeled PRIOR ART as disclosed in U.S. Pat. No. 4,598,769, referenced earlier. As illustrated, FIG. 1 illustrates the upper portion of apparatus 10 which has been lowered down a borehole 12, within a casing 14. In general, the apparatus would include an upper anchor assembly portion 16, connected at its upper end 18 to a wireline 20, for lowering the entire assembly 10 downhole. The anchor assembly 16 would include generally a series of jaws 22, which would extend outwardly (phantom view in FIG. 1) from the body 17 of anchor assembly 16, for engaging against the wall 25 of the casing 14 as illustrated. This primary anchoring system would be activated when the apparatus 10 is positioned downhole at the desired depth. It would be activated prior to the cutting operation to assure the stable positioning of the apparatus 10. Further, as a secondary anchoring system, there is provided a series of drag springs 26, which engage against the wall 25 of casing 14, above the jaws 22, also for stabilizing the tool 10 during the cutting operation. Such anchoring assemblies are quite common in the art, and reflect the conventional means for anchoring cutting tools of this type downhole.

FIG. 1 further illustrates the components within tool 10 for producing the cutting flame, which will be discussed in general, as they are used during the operation of the cutting apparatus. During the operation, the apparatus 10 would be lowered into the bore of the casing or pipe at the end of the wireline 20. The apparatus 10 would then be mechanically anchored via jaws 22 and drag springs 26 against the wall 25 of the casing 14. Once anchoring is achieved mechanically, an electric current is produced from the surface of the well, through electric conductors to the electrode plug 30, located in the upper portion of ignition portion 31, positioned below anchor portion 16, then on to prong 32, conductor 34, and spring 36 to squib 38, all positioned within ignition portion 31. Loosely packed pyrotechnic material 40 contained within ignition portion 31 is ignited by the current, which in turn ignites compressed combustible pyrotechnic material 40 is formed into pellets 42 surrounding the material 40. The pipe cutting flame produced by the ignited material 40 is directed toward the lower end 43 of ignition portion 31. There is then provided a nozzle means 44, comprising a plurality of cutting nozzles 46, each nozzle 46 for directing the pipe cutting flame 48 from the direction along the elongate axis of body 10 radially against the wall 25 of casing 14, to produce the cut along cutline 50. This operation, as generally described above is known in the art through the '769 Robertson patent. Although the cutting apparatus 10 has additional operational features, the operation of the tool is as generally described.

Figure 2:
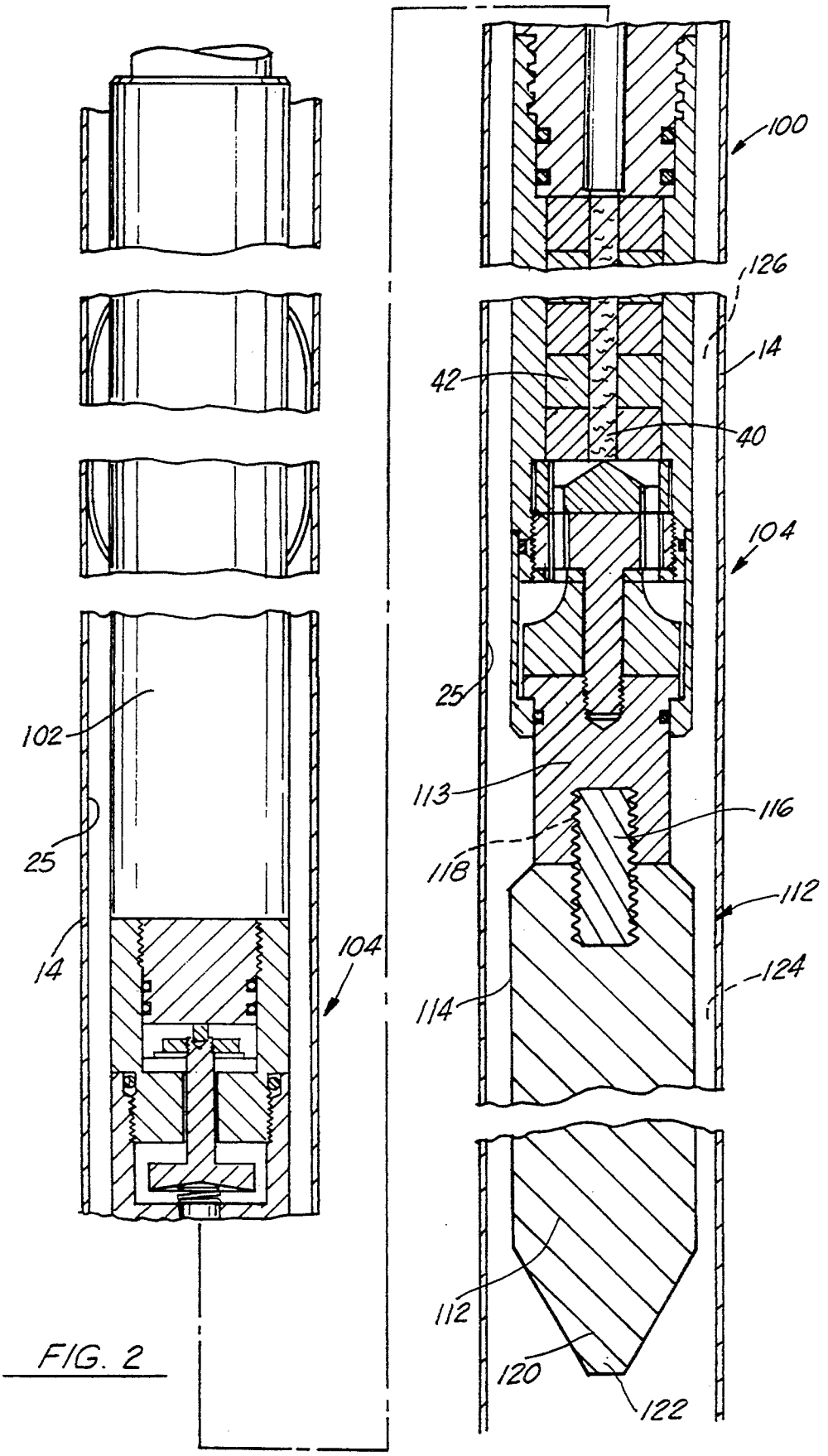
FIG. 2 illustrates an overall cross-sectional view of the preferred embodiment of the anchoring system of the present invention.
Figure 3:
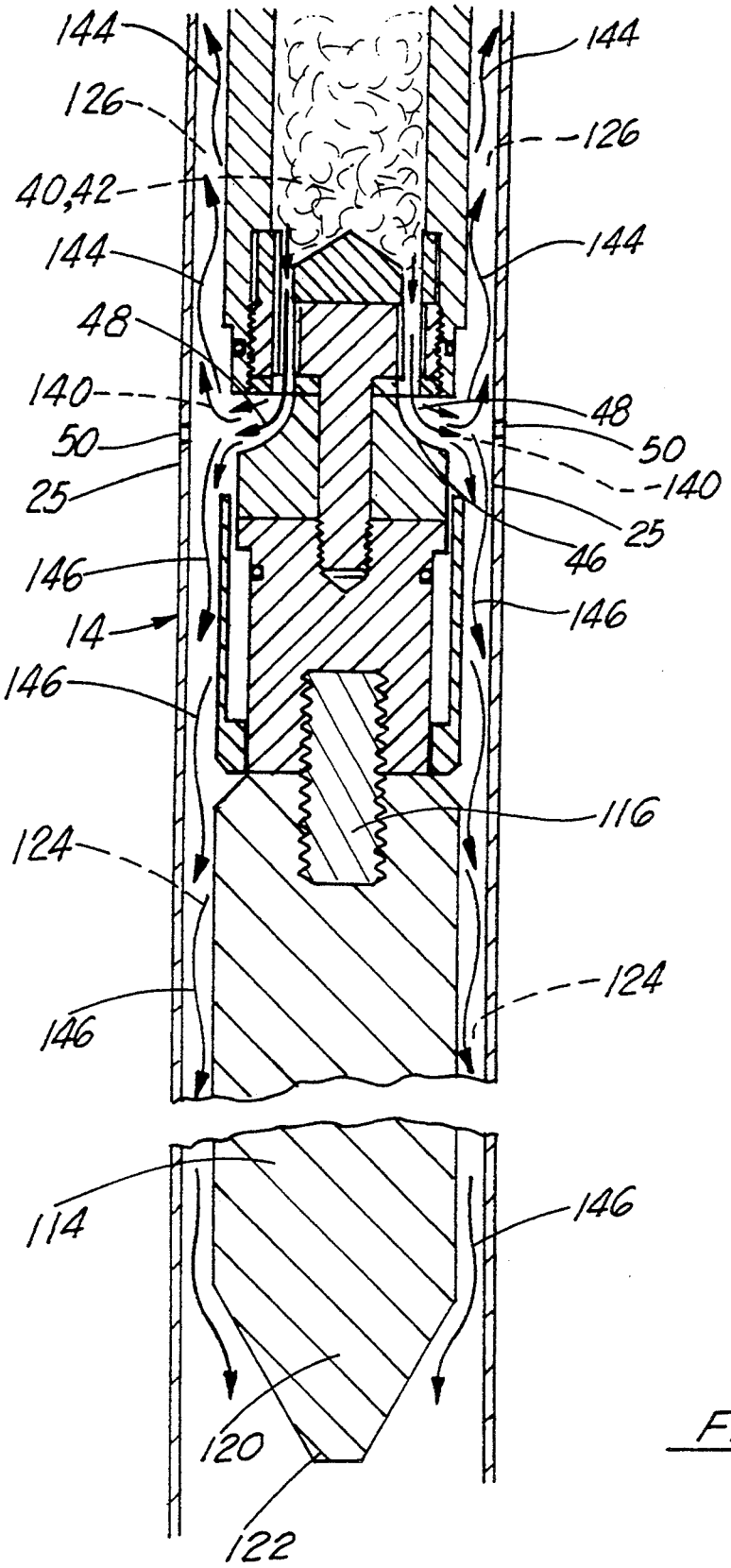
FIG. 3 illustrates an overall cross-sectional view of the cutting means of the present invention during and immediately following the cutting operation.

Turning now to the present invention, reference is made to FIGS. 2 and 3 which illustrate a modified cutting apparatus 100. A first important modification in tool 100 is the elimination of the mechanical anchoring assembly 16 which is found in the prior art. As is noted, the upper body portion 102 of tool 100 in FIG. 2 does not include the plurality of jaws 22 which, as seen in the prior art, would engage the wall 25 of the casing 14, and in fact eliminates all mechanical anchoring systems currently known. For explanation purposes, there is provided an ignition portion 104 of apparatus 100 which functions substantially identical to the ignition portion 31 of apparatus 10 described herein, and as more fully described in the '769 Robertson patent. The lower end of the ignition portion 104 has been modified to accommodate the new anchoring system to be described below.

What is provided is a novel means for anchoring the cutting tool 100 during the cutting operation. This novel anchoring means is illustrated by the numeral 110 in FIGS. 2 and 3. As illustrated, anchor means 110 includes an elongated anchor body portion 112 having an annular wall portion 114 along its length. Anchor body portion 112, in the preferred embodiment, may be threadably attached to the lower end 113 of ignition portion 104, via a threaded pin 116 engaged into a threaded port 118 or a similar type engagement or attachment by other means. The lower end 120 of the anchor body portion 112, as illustrated, may be formed into a conical point 122, for ease of lowering the tool 100 into the borehole.

As is illustrated, the overall diameter of anchor body portion 112 would be substantially equal to the overall diameter of cutting tool body 102. Therefore, the annular space 124 formed between the body 112 of anchor means 110 and casing 14 would be substantially equal to the annular space 126 between the body 102 of cutting tool 100 and the casing 14. Further, the overall length of anchor body 112 may vary; however, it is preferred that the overall length be generally equal to the overall length of cutting tool 100 from which it extends, for reasons to be explained further.

Turning now to the anchoring functions of anchor body 112, reference is made to FIG. 3. In FIG. 3, the firing mechanism of cutting tool 100 has been activated, and the ignitor material 40, 42 is producing the cutting flame (arrow 48) extending radially outward from tool 100 to cut the wall 25 of casing 14. During the cutting procedure, a great volume or "bubble" of residual gases (illustrated by arrows 140) is produced, and flows within the annuli 124,126 formed between the anchor body 112 and casing 14, and the tool body 102 and casing 14 respectively. Because of its length and diameter, anchor body 112 defines the annular space 124 between itself and casing 14 substantially equal to the annular space 126 formed by tool body 100 and casing 14. Therefore, as the gases travelling both upward, (arrows 144), and downward, (arrows 146), the volume of gas above the cutline 50 formed by the flame from the cutting nozzle 46 is equal to the volume of gas below the cutline 50, and is of equal pressure. Therefore, applying Boyle's Law, since the two annuli 124, 126 formed by the tool body 102 and the anchor body 112 are substantially equal, the volumes of the gas in each of the respective annuli 124, 126 is equal, since the pressure of the gas above the cutline 50 is essentially equal to the pressure of the same gas below the cutline 50. Thus, the resulting downward force of the gases above the cutline 50 is equal to the upward force of gases below the cutline 50. The resulting forces on the tool is therefore equalized, maintaining the tool 100 stable within the hole by the equal forces above and below the cutline.

Although the preferred embodiment of the present invention provides for an anchor body 112 substantially equal in length and diameter as upper tool body 110, this is not always required. What is required is that the resulting volume contained within the upper annulus 126 be equal to the volume of gas within the lower annulus 124, to result in equalizing of the upward and downward forces.

Since the cutting procedure takes place within a time frame of less than a second, this equalizing of pressures must be present only during that time, so that the cutline 50 may be as smooth and straight as possible. Should the volumes of the gases eventually change, and change the gas pressures, over a greater time, the position of the tool may shift. However, as long as the cut has been completed, the shifting of the tool 100 becomes immaterial, and the initial high pressures of the gases, during and immediately following the cut, will have been reduced rather rapidly, thus avoiding any possibility of causing the tool to travel upward at a dangerous speed within the hole.

In the discussion of the improved anchoring means as illustrated in operation in FIG. 3, the cutting means was referred to as a combustible cutting means. However, for purposes of the functioning of the improved anchoring means, the anchor could be utilized whether the cutting means was combustible cutting means or a chemical cutting means. The production of gases would result in a balancing of the forces, in either case, as described earlier. Furthermore, although in describing the cutting tool, reference has been made to cutting a casing wall, the cutting means may be utilized to cut the wall of any type of tubular member downhole, such as drill pipe, casing, or other types of pipe subs.

The following table lists the part numbers and part descriptions as used herein and in the drawings attached hereto.

PARTS LIST

| Part Number | Description |
|---|---|
| apparatus | 10 |
| borehole | 12 |
| casing | 14 |
| anchor assembly portion | 16 |
| upper end | 18 |
| wireline | 20 |
| jaws | 22 |
| body | 17 |
| wall | 25 |
| drag springs | 26 |
| electrode plug | 30 |
| ignition portion | 31 |
| prong | 32 |
| conductor | 34 |
| spring | 36 |
| squib | 38 |
| pyrotechnic material | 40 |
| pellets | 42 |
| lower end | 43 |
| nozzle means | 44 |
| cutting nozzles | 46 |
| arrow | 48 |
| cutline | 50 |
| modified apparatus | 100 |
| upper body portion | 102 |
| ignition portion | 104 |
| anchoring means | 110 |
| anchor body portion | 112 |
| annular wall portion | 114 |
| lower end | 113 |
| threaded pin | 116 |
| threaded port | 118 |
| lower end | 120 |
| conical point | 122 |
| annular space | 124 |
| annular space | 126 |
| arrows | 140 |
| arrows | 144 |

-continued

PARTS LIST

| Part Number | Description |
|---|---|
| arrows | 146 |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A cutting tool with improved anchoring system, for cutting the wall of tubular members, such as drill pipe, casing, or other tubular members disposed down a borehole, comprising:

a) an upper body portion lowered down the borehole and defining an annular space between the body portion and the wall of the tubular member;

b) cutting means disposed within the body portion for emitting a flame radially outward from the body portion against the wall of the tubular member, to cut the tubular member at a predetermined depth; and c) anchor means positioned along the body portion, defining an annular space below the cutting means so that the volume of gas emitted by the cutting means effects a force in the annulus above the cutting means substantially equal to the force in the annulus below the cutting means.

2. The cutting tool in claim 1, wherein the length of diameter of the body portion of the anchor means provides an annulus between the anchor body portion and the wall of the tubular member substantially equal to the volume of the annulus formed between the upper body portion and the wall of the tubular member.

3. The cutting tool in claim 1, wherein the anchor means is threadably engaged to a lower end of the upper body portion of the cutting tool.

4. The cutting tool in claim 1, wherein the cutting means includes a chemical cutting means for radiating outwardly from the body to cut the wall of the tubular member.

5. A cutting tool with improved anchoring system, for cutting the wall of pipe disposed down a borehole, comprising:

a) an upper body portion lowered down the borehole and defining an annular space between the body portion and the wall of the pipe;

b) cutting means disposed within the body portion for emitting a flame radially outward from the body portion against the wall of the pipe, to cut the pipe at a predetermined depth; and c) anchor means positioned below the cutting means, and defining an annular space below the cutting means, so that a volume of gas emitted by the cutting means during cutting effects a force in the annulus above the cutting means substantially equal to the force in the annulus below the cutting means to anchor the cutting apparatus during the cutting operation.

6. The cutting tool in claim 5, wherein the cutting means may include a chemical cutting means for radiating outwardly from the body to cut the pipe wall.

7. The cutting tool in claim 5, wherein the cutting tool is utilized to cut various types of tubular members downhole.

8. A cutting tool for cutting the wall of pipe disposed down a borehole of the type having an upper body portion lowered down the borehole and defining an annular space between the body portion and the wall of the pipe; a cutting means disposed within the elongated body portion for emitting a flame radially outward from the body portion against the wall of the pipe to cut the pipe at a predetermined depth; the improvement comprising:

anchor means positioned below the cutting means, and defining an annular space below the cutting means substantially equal to the annular space defined by the body portion, so that a volume of gas emitted by the cutting means during the cutting operation creates a force in the annulus above the cutting means substantially equal to the force in the annulus below the cutting means to anchor the cutting apparatus.

9. The cutting tool in claim 8, wherein the cutting means includes a chemical cutting means for radiating outwardly from the body to cut the pipe wall.

10. A method of anchoring a cutting tool used in cutting the wall of pipe disposed down a borehole, comprising the following steps:

a. providing a tool having an upper tool portion;

b. lowering the tool down a pipe or casing to a desired depth, the tool being of a diameter so as to define an annular space between an outer surface of the tool and the casing wall;

c. providing a cutting means disposed within the upper tool for emitting a flame radially outward from the upper tool portion against the wall of the pipe to cut the pipe at said desired depth when the cutting means is ignited;

d. securing an anchor means along a bottom of the upper tool portion below the cutting means, said anchor means being of a diameter so as to define an annular space between an outer surface of the anchor means and the casing wall substantially equal to the annular space between the upper tool portion of the tool and the casing wall;

e. igniting the cutting means, so that a flame is emitted radially from the cutting means and cuts the wall of the casing, and producing a gas as a result of the ignition, so that the volume of gas emitted by the cutting means during the cutting operation creates a force in the annulus above the cutting means substantially equal to the force in the annulus below the cutting means, acting to anchor the cutting apparatus within the borehole during the cutting operation.

* * * * *